US011225082B2

(12) United States Patent
Kanegae et al.

(10) Patent No.: US 11,225,082 B2
(45) Date of Patent: Jan. 18, 2022

(54) CHANNEL STRUCTURE, LIQUID EJECTING UNIT, AND LIQUID EJECTING APPARATUS

(71) Applicant: SEIKO EPSON CORPORATION, Tokyo (JP)

(72) Inventors: Takahiro Kanegae, Shiojiri (JP); Katsuhiro Okubo, Azumino (JP); Hisashi Sato, Shiojiri (JP); Ken Yamagishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/725,441

(22) Filed: Dec. 23, 2019

(65) Prior Publication Data

US 2020/0207105 A1 Jul. 2, 2020

(30) Foreign Application Priority Data

Dec. 26, 2018 (JP) ..... JP2018-241975

(51) Int. Cl.
*B41J 2/175* (2006.01)
*B41J 2/14* (2006.01)
*B41J 2/045* (2006.01)

(52) U.S. Cl.
CPC ..... *B41J 2/17513* (2013.01); *B41J 2/04501* (2013.01); *B41J 2/14* (2013.01); *B41J 2/17556* (2013.01); *B41J 2/17596* (2013.01); *B41J 2002/14403* (2013.01); *B41J 2202/20* (2013.01)

(58) Field of Classification Search
CPC . B41J 2/04501; B41J 2/14; B41J 2/175; B41J 2/17513; B41J 2/17556; B41J 2/17563; B41J 2/17596; B41J 2002/14403; B41J 2202/20
See application file for complete search history.

(56) References Cited

U.S. PATENT DOCUMENTS 6,957,882 B2 * 10/2005 Wouters ..... B41J 2/17513 347/86
8,360,567 B2 * 1/2013 Ito ..... B41J 2/17556 347/92
8,678,559 B2 * 3/2014 Nakao ..... B41J 2/14274 347/65
8,814,294 B2 * 8/2014 Shibata ..... B41J 2/175 347/6

(Continued)

FOREIGN PATENT DOCUMENTS

JP 2013154555 8/2013
JP 2015123690 7/2015

*Primary Examiner* — Anh T Vo
(74) *Attorney, Agent, or Firm* — Workman Nydegger

(57) ABSTRACT

A channel structure includes a base body having a first surface, a second surface that is opposite from the first surface, and a side surface that extends in a direction intersecting the first surface. The base body includes a first channel having a supply port into which a liquid is supplied, a liquid storing chamber formed in the first surface and storing the liquid, a second channel having a discharge port through which the liquid in the liquid storing chamber is discharged, and a pressure adjusting unit that supplies the liquid from the first channel to the liquid storing chamber according to pressure in the liquid storing chamber and that located between the first surface and the second surface. The supply port is formed in the second surface of the base body or formed in the side surface of the base body.

19 Claims, 7 Drawing Sheets

(56) References Cited

U.S. PATENT DOCUMENTS

| | | | | |
|---|---|---|---|---|
| 2007/0052775 | A1* | 3/2007 | Jung | B41J 2/19 347/86 |
| 2008/0225090 | A1* | 9/2008 | Kobayashi | B41J 2/17509 347/85 |
| 2009/0244131 | A1* | 10/2009 | Shibata | B41J 2/14233 347/9 |
| 2013/0194360 | A1 | 8/2013 | Nakao | |
| 2015/0085034 | A1* | 3/2015 | Aruga | C09D 11/38 347/93 |
| 2015/0183226 | A1 | 7/2015 | Kudo | |

* cited by examiner

CHANNEL STRUCTURE, LIQUID EJECTING UNIT, AND LIQUID EJECTING APPARATUS

The present application is based on, and claims priority from JP Application Serial Number 2018-241975, filed Dec. 26, 2018, the disclosure of which is hereby incorporated by reference herein in its entirety.

BACKGROUND

1. Technical Field

The present disclosure relates to a channel structure for supplying a liquid to a liquid ejecting head.

2. Related Art

A liquid ejecting head that ejects a liquid such as ink from a plurality of nozzles receives the liquid from a liquid container such as a cartridge through a channel structure. For example, JP A-2013-154555 discloses a channel member for supplying ink to a liquid ejecting head. In the upper surface of the channel member, there are formed a liquid inlet into which the ink is supplied from a tank, and a groove-shaped channel in which the ink supplied from the liquid inlet is stored through a pressure adjusting valve. The ink stored in the groove-shaped channel is supplied to the liquid ejecting head from an opening formed in the lower surface of the channel member on the opposite side from its upper surface.

SUMMARY

In the technique of JP A-2013-154555, the liquid inlet and the groove-shaped channel are formed in the upper surface of the channel member. In other words, the liquid inlet and the groove-shaped channel are located in the same plane of the channel member. This leads to a problem of increasing the size of the channel member.

To solve the above problem, a channel structure according to a preferred aspect of the present disclosure includes, in a base body having a first surface: a first channel having a supply port into which a liquid is supplied; a liquid storing chamber formed in the first surface and storing the liquid; a second channel having a discharge port through which the liquid in the liquid storing chamber is discharged; and a pressure adjusting unit that supplies the liquid from the first channel to the liquid storing chamber according to pressure in the liquid storing chamber. The supply port is formed in a second surface of the base body on an opposite side from the first surface as viewed from the pressure adjusting unit or formed in a side surface of the base body extending to the first surface in a crossing direction.

A channel structure according to a preferred aspect of the present disclosure includes, in a base body having a first surface: a first channel having a supply port into which a liquid is supplied; a liquid storing chamber formed in the first surface and storing the liquid; a second channel having a discharge port through which the liquid in the liquid storing chamber is discharged; and a pressure adjusting unit that supplies the liquid from the first channel to the liquid storing chamber according to pressure in the liquid storing chamber. The supply port is formed at a position overlapping the liquid storing chamber as viewed from a direction perpendicular to the first surface.

A liquid ejecting unit according to a preferred aspect of the present disclosure includes: any of the above channel structures; and a liquid ejecting head that ejects the liquid supplied from the channel structure.

A liquid ejecting apparatus according to a preferred aspect of the present disclosure includes: any of the above channel structures; and a liquid ejecting head.

A liquid ejecting apparatus according to a preferred aspect of the present disclosure includes: any of the above channel structures; and a liquid ejecting head that ejects the liquid supplied from the channel structure.

DESCRIPTION OF EXEMPLARY EMBODIMENTS

First Embodiment

Figure 1:
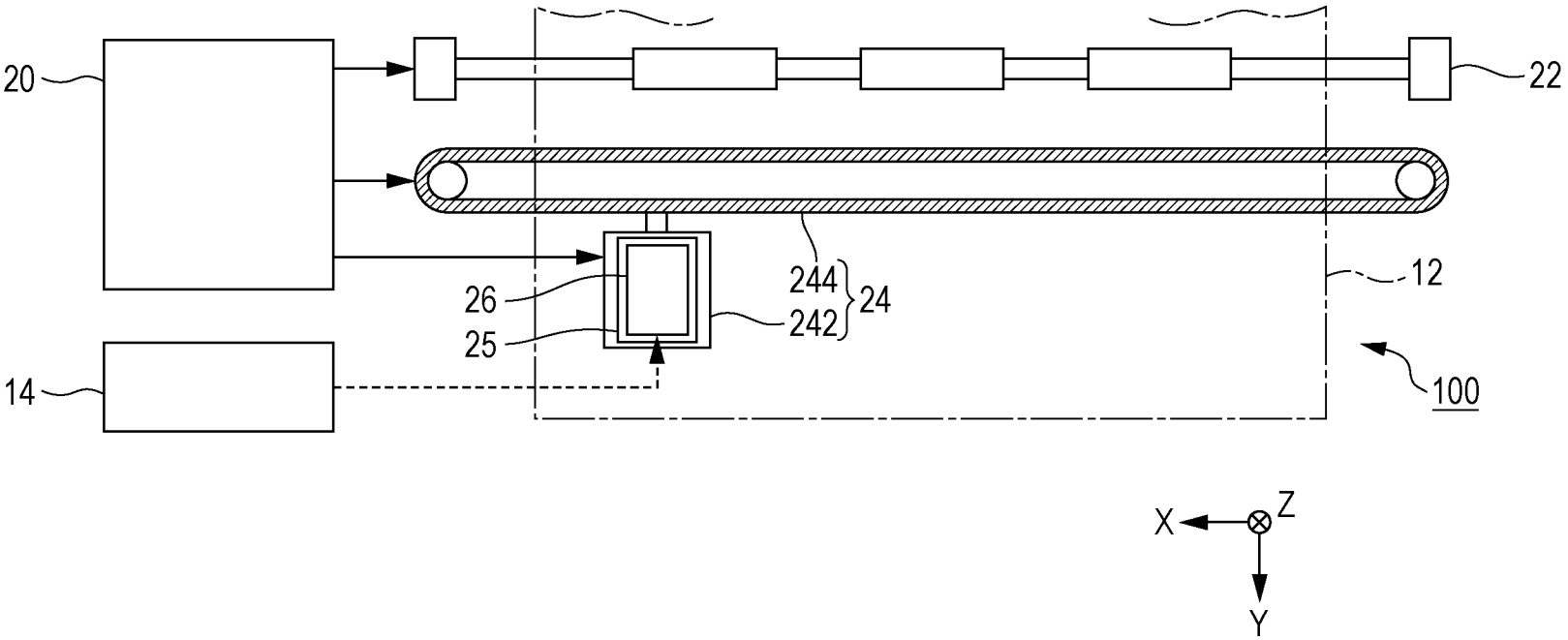
FIG. 1 is a configuration diagram of a liquid ejecting apparatus according to a first embodiment.

FIG. 1 is a configuration diagram exemplarily illustrating a liquid ejecting apparatus 100 according to a first embodiment of the present disclosure. The liquid ejecting apparatus 100 in the first embodiment is an ink jet recording apparatus that ejects ink being an example of liquid onto a medium 12. The medium 12 is typically recording paper but a recording object of any material such as a resin film or cloth is usable as the medium 12. As exemplarily illustrated in FIG. 1, a liquid container 14 storing ink is installed in the liquid ejecting apparatus 100. For example, a cartridge detachably attachable to the liquid ejecting apparatus 100, a bag-shaped ink pack made of a flexible film, or an ink tank capable of being refilled with ink is used as the liquid container 14.

As exemplarily illustrated in FIG. 1, the liquid ejecting apparatus 100 includes a control unit 20, a transporting mechanism 22, a moving mechanism 24, a channel structure 25, and a liquid ejecting head 26. The control unit 20 includes a processing circuit such as a central processing unit (CPU) or a field programmable gate array (FPGA) and a storage circuit such as a semiconductor memory, for example, and takes overall control of components in the liquid ejecting apparatus 100. The control unit 20 is an example of a controller. The transporting mechanism 22 transports the medium 12 in a Y direction under control of the control unit 20.

The moving mechanism 24 reciprocates the channel structure 25 and the liquid ejecting head 26 in an X direction under control of the control unit 20. The X direction is a direction crossing the Y direction, in which the medium 12 is transported. Specifically, the X direction and the Y direction cross each other perpendicularly. The moving mechanism 24 in the first embodiment includes a substantially box-shaped transporter 242 housing the channel structure 25 and the liquid ejecting head 26, and a transporting belt 244 to which the transporter 242 is fixed. Note that a configuration in which a plurality of liquid ejecting heads 26 and a plurality of channel structures 25 are mounted on the transporter 242 or a configuration in which the liquid container 14 is mounted on the transporter 242 along with the liquid ejecting head 26 and the channel structure 25 can be employed.

The channel structure 25 is a structure for adjusting the supply of ink from the liquid container 14 to the liquid ejecting head 26. The liquid ejecting head 26 ejects the ink supplied from the channel structure 25. Specifically, the liquid ejecting head 26 ejects the ink supplied from the liquid container 14 onto the medium 12 from a plurality of nozzles under control of the control unit 20. A desired image is formed on a surface of the medium 12 by causing the liquid ejecting head 26 to eject the ink onto the medium 12 in parallel with transport of the medium 12 by the transporting mechanism 22 and repetitive reciprocation of the transporter 242.

Figure 2:
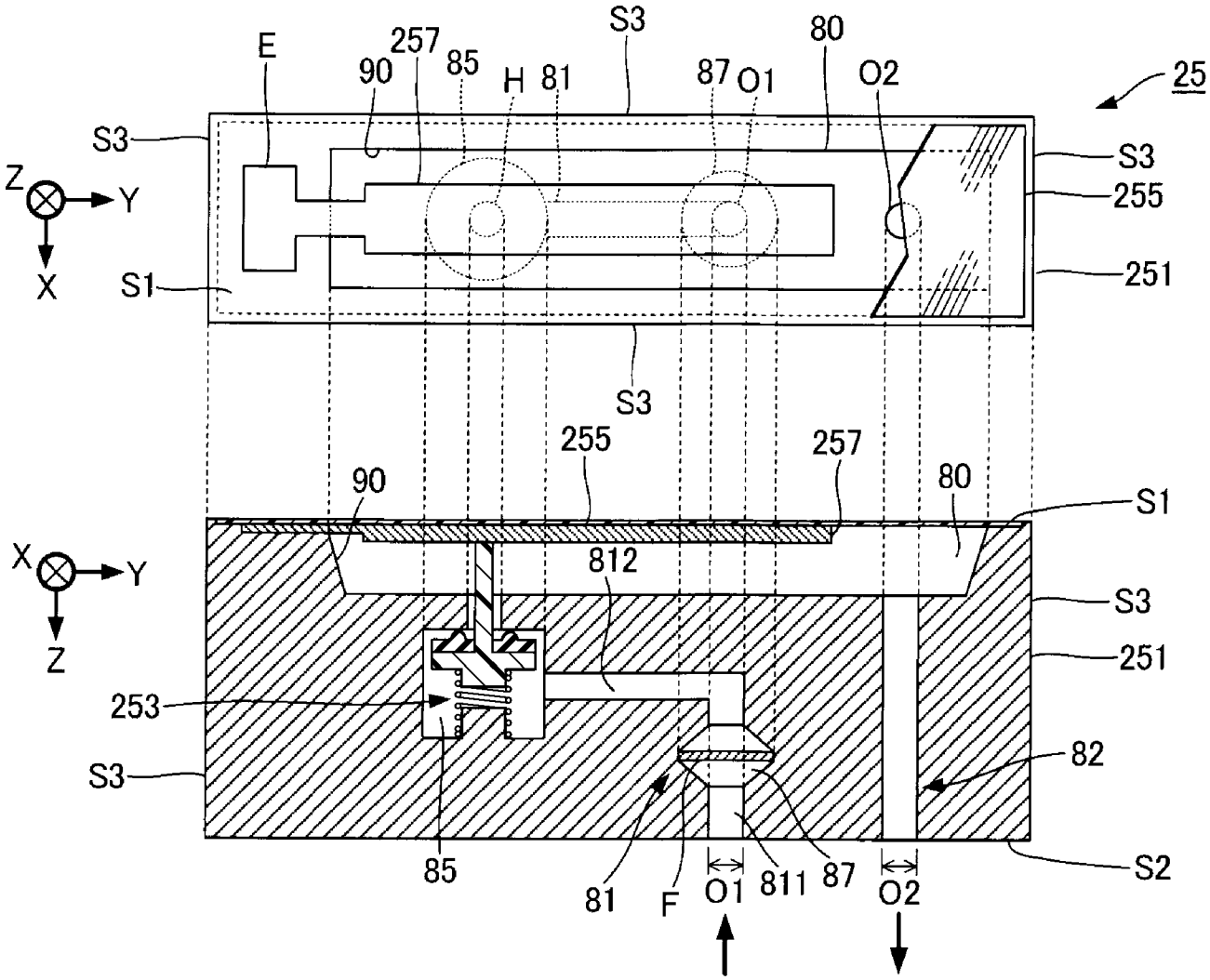
FIG. 2 is a plan view and a cross-sectional view of a channel structure.

FIG. 2 is a plan view and a cross-sectional view of the channel structure 25. The channel structure 25 includes a base body 251. The base body 251 is a plate-shaped member in which to form channels for ink supplied from the liquid container 14, and has a first surface S1, a second surface S2 on the opposite side from the first surface S1, and side surfaces S3 extending to the first surface S1 and the second surface S2 in a crossing direction. The first surface S1 and the second surface S2 are located on mutually opposite sides as viewed from a pressure adjusting unit 253 to be described later. As exemplarily illustrated in FIG. 2, the surface of the base body 251 on the negative side in a Z direction is the first surface S1, and the surface of the base body 251 on the positive side in the Z direction is the second surface S2. Further, the four side surfaces S3 are located on the positive and negative sides of the base body 251 in the X direction and the positive and negative sides of the base body 251 in the Y direction. The liquid ejecting head 26 is installed on the second surface S2 of the base body 251. As exemplarily illustrated in FIG. 2, a first channel 81, a second channel 82, a pressure adjusting chamber 85, and a liquid storing chamber 80 are formed in the base body 251 in the first embodiment. Ink supplied from the liquid container 14 passes through the first channel 81, the pressure adjusting chamber 85, the liquid storing chamber 80, and the second channel 82 in this order and is then supplied to the liquid ejecting head 26. Note that the base body 251 may be formed of a single member or formed by, for example, laminating a plurality of members.

As exemplarily illustrated in FIG. 2, a recessed portion 90 is formed in the first surface S1. The recessed portion 90 is a groove formed in an elongated shape along the Y direction, for example. A sealing body 255 is installed on the first surface S1 so as to seal the opening of the recessed portion 90. The sealing body 255 is, for example, a film-shaped member and made of a flexible resin material such as polypropylene (PP) or polyphenylenesulfide (PPS). The space surrounded by the recessed portion 90 and the sealing body 255 functions as the liquid storing chamber 80. In other words, the space having the sealing body 255, which is installed on the first surface S1, and the inner wall of the recessed portion 90 as its wall surfaces is the liquid storing chamber 80. Specifically, the liquid storing chamber 80 is a planar space extending in the Y direction in the first surface S1. To put it differently, the Y direction is the direction in which the liquid storing chamber 80 extends. The sealing body 255 is elastically deformed according to the pressure inside the liquid storing chamber 80.

The pressure adjusting chamber 85 is a space through which the first channel 81 and the liquid storing chamber 80 communicate each other. As exemplarily illustrated in FIG. 2, the pressure adjusting chamber 85 is a circular space as viewed from the Z direction, which is perpendicular to the first surface S1. The Z direction corresponds to the vertical direction. In the first embodiment, the pressure adjusting chamber 85 is formed at a position overlapping the liquid storing chamber 80 in plan view from the Z direction.

Figure 3:
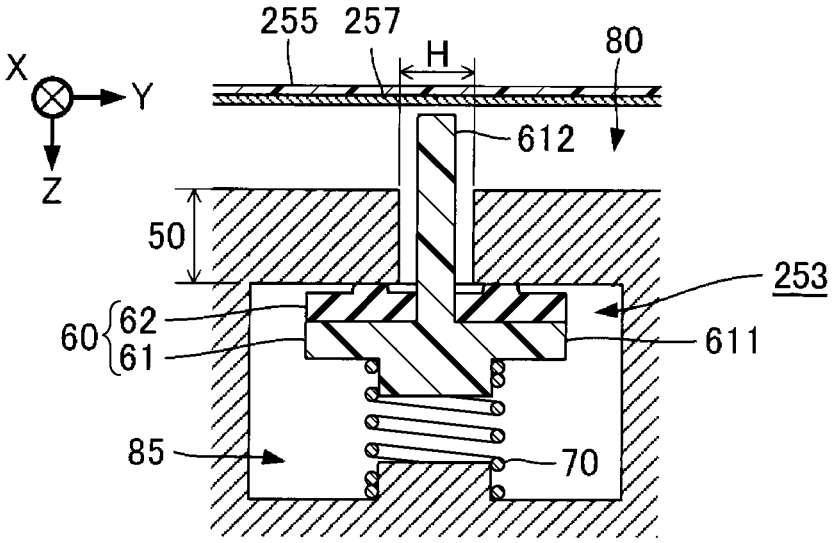
FIG. 3 is a cross-sectional view of a pressure adjusting unit.

The pressure adjusting unit 253 is provided in the pressure adjusting chamber 85. FIG. 3 is an enlarged view of the pressure adjusting unit 253 in FIG. 2. The pressure adjusting unit 253 is a unit that supplies ink from the first channel 81 to the liquid storing chamber 80 according to the pressure inside the liquid storing chamber 80. The pressure adjusting unit 253 in the first embodiment is a valve device that switches the opening/closing (closing/opening) of the pressure adjusting chamber 85 according to the pressure inside the liquid storing chamber 80. Specifically, in a normal state where the pressure inside the liquid storing chamber 80 is within a predetermined range, the pressure adjusting unit 253 blocks communication between the pressure adjusting chamber 85 and the liquid storing chamber 80. On the other hand, as the pressure inside the liquid storing chamber 80 drops due to ejection of ink by the liquid ejecting head 26 or suction of ink from outside, for example, the pressure adjusting unit 253 allows the pressure adjusting chamber 85 and the liquid storing chamber 80 to communicate with each other. In the state where the pressure adjusting chamber 85 and the liquid storing chamber 80 communicate with each other, ink supplied from the liquid container 14 to the pressure adjusting chamber 85 through the first channel 81 flows into the liquid storing chamber 80 and is then supplied to the liquid ejecting head 26 through the second channel 82. In other words, the first channel 81 is located upstream of the pressure adjusting unit 253, and the liquid storing chamber 80 is located downstream of the pressure adjusting unit 253.

As exemplarily illustrated in FIG. 3, the pressure adjusting unit 253 in the first embodiment includes a valve seat 50, a valve body 60, and a spring 70. Simply put, the valve body 60 moves in the negative side and the positive side in the Z direction relative to the valve seat 50 to switch the opening/closing of the pressure adjusting chamber 85 and the liquid storing chamber 80 with respect to each other. The valve seat 50 is a portion located between the pressure adjusting chamber 85 and the liquid storing chamber 80 and faces the sealing body 255 with a gap therebetween. In other words, the valve seat 50 functions as a partition wall separating the pressure adjusting chamber 85 and the liquid storing chamber 80. A through-hole H being a hole of a perfect circle is formed in the center of the valve seat 50. The pressure adjusting chamber 85, which is located upstream of the valve seat 50, and the liquid storing chamber 80, which is located downstream of the valve seat 50, communicate with each other through the through-hole H in the valve seat 50. A pressure receiving plate 257 is installed on the surface of the sealing body 255 on the valve seat 50 side. The pressure receiving plate 257 is an elongated planer plate member, for example. As exemplarily illustrated in FIG. 2, a fixed end E of the pressure receiving plate 257 being one end thereof is fixed to the base body 251 at a region in the first surface S1 located on the negative side in the Y direction as viewed from the recessed portion 90. Note that the pressure receiving plate 257 may be omitted.

The valve body 60 and the spring 70 are disposed inside the pressure adjusting chamber 85. The spring 70 is installed between a wall surface of the pressure adjusting chamber 85 and the valve body 60, and biases the valve body 60 toward the valve seat 50. The valve body 60 includes a support body 61 and an elastic body 62, as exemplarily illustrated in FIG. 3. The support body 61 is a structure supporting the elastic body 62. The support body 61 is formed by injection molding of a resin material such as polyoxymethylene (POM) or polypropylene, for example. Polyoxymethylene is characterized by being high in mechanical strengths such as wear resistance and solvent resistance. Thus, polyoxymethylene is particularly preferable as the material of the support body 61, which constantly contacts ink and is repetitively pressed.

The support body 61 includes a base portion 611 and a valve shaft 612 formed integrally with each other. The base portion 611 is a planar plate-shaped portion shaped into a disk with an outer diameter larger than the inner diameter of the through-hole H. The valve shaft 612 is a straight bar-shaped portion protruding in the Z direction from a surface of the base portion 611. The diameter of the valve shaft 612 is smaller than the inner diameter of the through-hole H. As exemplarily illustrated in FIG. 3, the valve shaft 612 is inserted in the through-hole H and penetrates through the valve seat 50. In other words, the tip of the valve shaft 612 projects from the valve seat 50 toward the sealing body 255 and faces the sealing body 255. The valve shaft 612 and the inner peripheral surface of the through-hole H face each other with a gap therebetween.

The elastic body 62 is a structure made of an elastic material. The elastic body 62 in the first embodiment is formed in an annular shape in plan view and is fixed to the base portion 611 with the valve shaft 612 penetrating through the elastic body 62. The elastic body 62 is located between the base portion 611 of the support body 61 and the valve seat 50, and functions as a seal that closes the through-hole H by contacting the valve seat 50.

With the above configuration, in the normal state where the pressure inside the liquid storing chamber 80 is maintained within a predetermined range, the spring 70 biases the valve body 60 to bring the elastic body into contact with a surface of the valve seat 50. Thus, as exemplarily illustrated in FIG. 2, the valve body 60 is maintained in a closed state where it closes the through-hole H in the valve seat 50. In other words, communication between the pressure adjusting chamber 85 and the liquid storing chamber 80 is blocked. On the other hand, as the pressure inside the liquid storing chamber 80 drops due to ejection of ink by the liquid ejecting head 26 or suction of ink from outside, for example, the sealing body 255 is displaced toward the valve seat 50, so that the pressure receiving plate 257 presses the valve shaft 612 of the valve body 60 against the bias of the spring 70. As the valve body 60 is moved toward the positive side in the Z direction by the pressing by the sealing body 255, the valve body 60 transitions to an open state where the elastic body 62 is separated from the valve seat 50. In the open state, the through-hole H in the valve seat 50 is opened, so that the pressure adjusting chamber 85 and the liquid storing chamber 80 communicate with each other through the through-hole H.

As exemplarily illustrated in FIG. 2, the first channel 81 is a channel having a supply port O1 into which ink is supplied from the liquid container 14, and formed from the supply port O1 to the pressure adjusting chamber 85. The first channel 81 is located upstream of the pressure adjusting chamber 85. In the first embodiment, the first channel 81 is located on the opposite side of the pressure adjusting unit 253 from the end of the recessed portion 90 on the negative side in the Y direction in plan view from the Z direction. The supply port O1 is an opening formed in a surface of the base body 251 other than the first surface S1. The supply port O1 in the first embodiment is formed in the second surface S2. Specifically, the supply port O1 is formed at a position overlapping the liquid storing chamber 80 in plan view from the Z direction. The first channel 81 in the first embodiment includes a first portion 811 and a second portion 812, for example. The first portion 811 is a portion of the first channel 81 formed along the Z direction from the supply port O1. The first portion 811 is formed such that the end of the first portion 811 on the opposite side from the supply port O1 overlaps the pressure adjusting chamber 85 as viewed from the Y direction. The second portion 812 is a portion of the first channel 81 formed along the Y direction to the pressure adjusting chamber 85 from the end of the first portion 811 on the opposite side from the supply port O1. The first channel 81 communicates with the pressure adjusting chamber 85 from the second channel 82 side as viewed from the pressure adjusting chamber 85. In the first embodiment, the entirety of the first channel 81 overlaps the liquid storing chamber 80 in plan view. A filter chamber 87 is formed at an intermediate portion of the first channel 81. The filter chamber 87 overlaps the liquid storing chamber 80 in plan view. The filter chamber 87 is located between the pressure adjusting unit 253 and the second channel 82 in plan view from the Z direction. A filter F for capturing bubbles and foreign matters included in ink is installed in the filter chamber 87. Note that the filter chamber 87 and the filter F may be omitted.

The second channel 82 is a channel having a discharge port O2 through which to discharge the ink in the liquid storing chamber 80, and formed from the liquid storing chamber 80 to the discharge port O2. The second channel 82 is located downstream of the liquid storing chamber 80. In the first embodiment, the second channel 82 is located on the opposite side of the first channel 81 from the pressure adjusting unit 253 in the Y direction in plan view from the Z direction. In other words, the first channel 81 is located between the pressure adjusting unit 253 and the second channel 82 in the Y direction in plan view. The discharge port O2 is an opening formed in a surface of the base body 251 other than the first surface S1. The discharge port O2 in the first embodiment is formed in the second surface S2. Specifically, the discharge port O2 is formed at a position overlapping the liquid storing chamber 80 in plan view. The second channel 82 is formed along the Z direction from the discharge port O2 to the liquid storing chamber 80, for example. In other words, the entirety of the second channel 82 overlaps the liquid storing chamber 80 in plan view. As exemplarily illustrated in FIG. 2, in the first embodiment, the supply port O1 is located between the pressure adjusting unit 253 and the discharge port O2 in the Y direction in plan view from the Z direction. The channel structure 25 and the liquid ejecting head 26 function as a liquid ejecting unit.

Here, assume for example a configuration in which the supply port O1 is formed in the first surface S1 of the base body 251, in which the liquid storing chamber 80 is formed (hereinafter referred to as "comparative example"). In the comparative example, the supply port O1 is formed in the first surface S1 in such a manner as to avoid the liquid storing chamber 80, the pressure receiving plate 257, and the sealing body 255. For example, the supply port O1 is formed on the negative side of the first surface S1 in the Y direction as viewed from the liquid storing chamber 80.

In contrast, in the first embodiment, the supply port O is formed in a surface of the base body 251 other than the first surface S1, in which the liquid storing chamber 80 is formed. Accordingly, the size of the channel structure 25 can be smaller than that in the comparative example. The sizes of the channel structure 25 in the X direction and the Y direction, which are parallel to the first surface S1, can be smaller with the configuration in the first embodiment, in which the supply port O1 is formed in the second surface S2 on the opposite side from the first surface S1, than with a configuration in which the supply port O1 is formed in one of the side surfaces S3 of the base body 251, which extend to the first surface S1 in a crossing direction.

Second Embodiment

A second embodiment will be described below. Note that in examples to be described below, reference numerals used in the description of the first embodiment will be used again for components with similar functions to those in the first embodiment, and detailed description of these components will be omitted as appropriate. In the following embodiments, a liquid storing chamber 80, a pressure adjusting chamber 85, and a second channel 82 are formed in a base body 251 as in the first embodiment.

Figure 4:
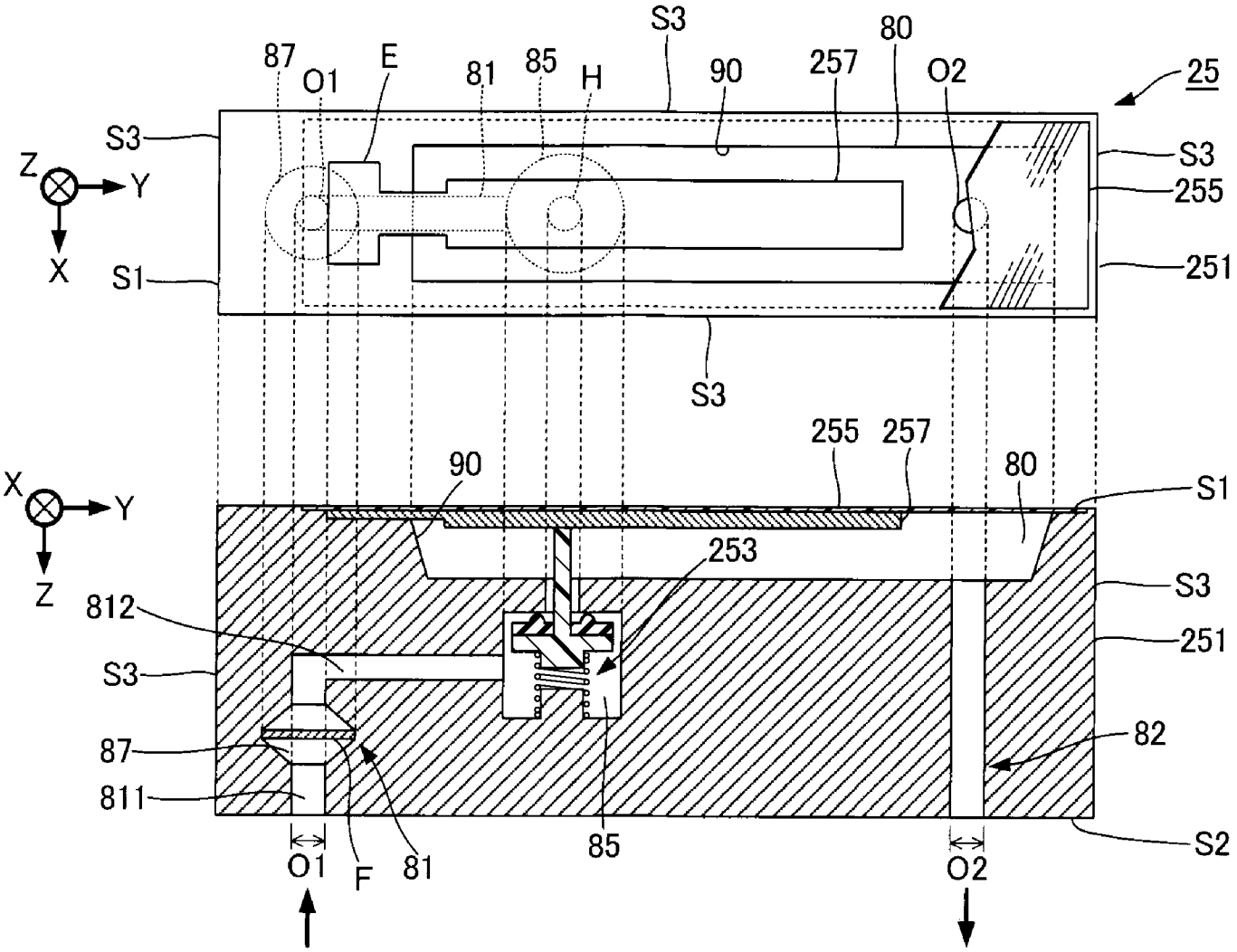
FIG. 4 is a plan view and a cross-sectional view of a channel structure according to a second embodiment.

FIG. 4 is a plan view and a cross-sectional view of a channel structure 25 according to the second embodiment. As exemplarily illustrated in FIG. 4, in the second embodiment, a first channel 81 is formed on the opposite side of a pressure adjusting unit 253 from the second channel 82 in the Y direction in plan view from the Z direction. A supply port O1 of the first channel 81 is located in a second surface S2. Note that in plan view from the Z direction, the supply port O1 in the second embodiment is located on the opposite side from the second channel 82 in the Y direction as viewed from the pressure adjusting unit 253. In the second embodiment, the supply port O1 is formed at a position not overlapping the liquid storing chamber 80 in plan view from the Z direction. However, as in the first embodiment, the supply port O1 may be formed at a position overlapping the liquid storing chamber 80 in plan view. The first channel 81 includes a first portion 811 formed along the Z direction from the supply port O1 and a second portion 812 formed along the Y direction from the end of the first portion 811 on the opposite side from the supply port O1 to the pressure adjusting chamber 85. The first channel 81 communicates with the pressure adjusting chamber 85 from the opposite side of the pressure adjusting chamber 85 from the second channel 82. The first portion 811 is formed such that the end of the first portion 811 on the opposite side from the supply port O1 overlaps the pressure adjusting chamber 85 as viewed from the Y direction. A filter chamber 87 is formed at an intermediate portion of the first portion 811, as in the first embodiment. The second channel 82 and the filter chamber 87 are located on mutually opposite sides of the pressure adjusting unit 253 in the Y direction in plan view from the Z direction.

The second embodiment also achieves an advantageous effect similar to that in the first embodiment. However, the effect of reducing the size of the channel structure 25 in the Y direction, which is parallel to the first surface S1, is higher with the configuration in the first embodiment, in which the first channel 81 is located between the pressure adjusting unit 253 and the second channel 82 in plan view from the Z direction, than with the configuration in the second embodiment, in which the first channel 81 is located on the opposite side of the pressure adjusting unit 253 from the second channel 82. The channel length of the second portion 812 and the inner diameter of the filter chamber 87 affect the size of the channel structure 25 in the Y direction. Thus, the configuration in the first embodiment is effective particularly when the second portion 812 has a large the channel length or the filter chamber 87 has a large inner diameter. However, when the second portion 812 or the filter chamber 87 is sufficiently small, the size of the channel structure 25 in the Y direction can be reduced also in the second embodiment as in the first embodiment.

Note that although the first channel 81 includes the first portion 811 and the second portion 812 in the first and second embodiments, the configuration of the first channel 81 is not limited to the above example. For example, a configuration in which the first channel 81 includes portions different from the first portion 811 and the second portion 812 or a configuration in which the first channel 81 is in a straight shape may be employed. Also, although the second channel 82 is exemplarily described as being formed along the Z direction in the first and second embodiments, the configuration of the second channel 82 is not limited to the above example. For example, the second channel 82 may be formed of a plurality of different portions.

Third Embodiment

Figure 5:
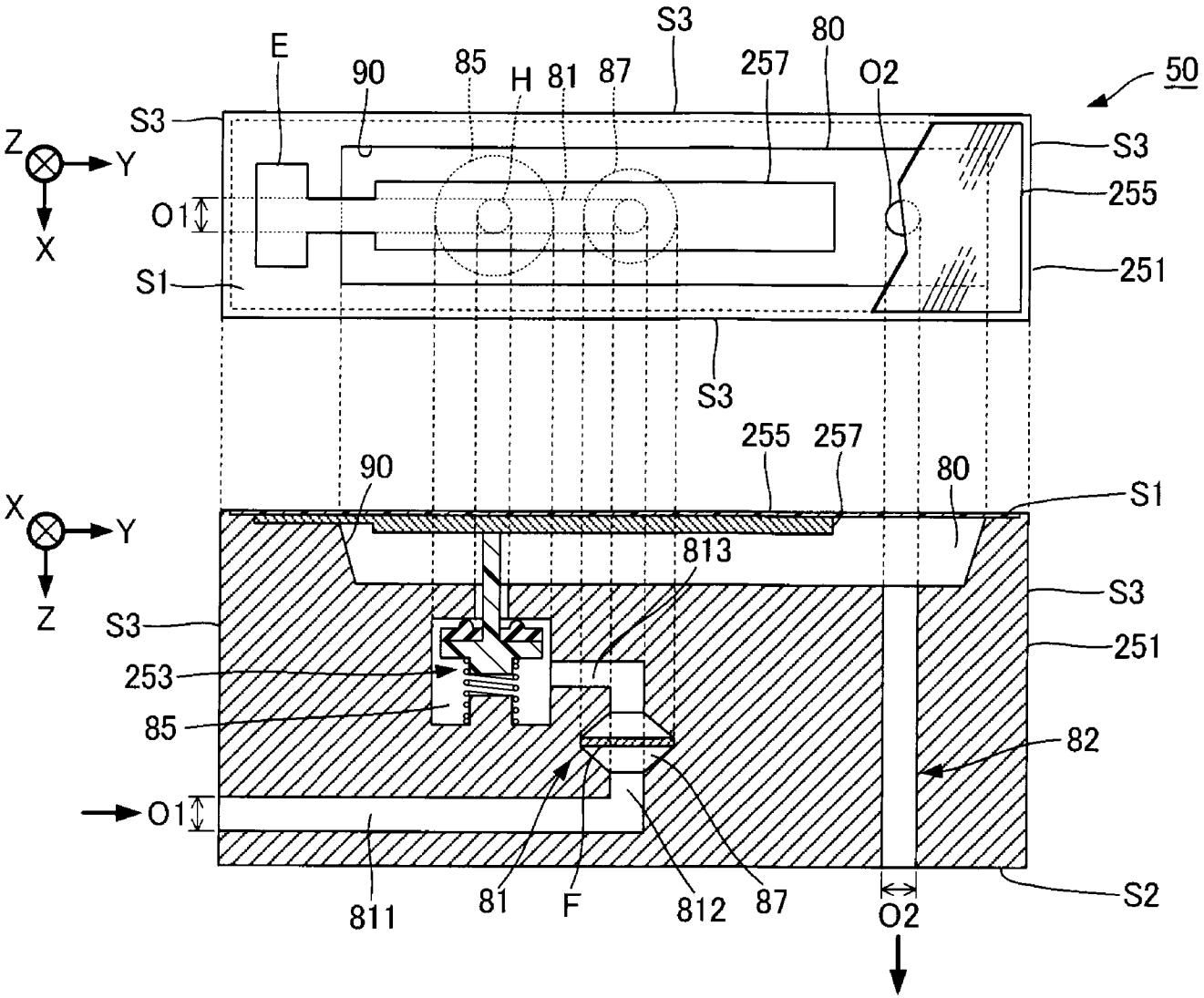
FIG. 5 is a plan view and a cross-sectional view of a channel structure according to a third embodiment.

FIG. 5 is a plan view and a cross-sectional view of a channel structure 25 according to a third embodiment. As exemplarily illustrated in FIG. 5, in the third embodiment, a supply port O1 is formed in one of side surfaces S3 of a base body 251. Specifically, the supply port O1 is formed in the side surface S3 on the opposite side from a second channel 82 as viewed from a pressure adjusting unit 253. The first channel 81 in the third embodiment includes a first portion 811, a second portion 812, and a third portion 813. The first portion 811 is a portion of the first channel 81 formed along the Y direction from the supply port O1. The second portion 812 is a portion of the first channel 81 communicating with the first portion 811 and formed along the Z direction. The third portion 813 is a portion of the first channel 81 communicating with the second portion 812 and a pressure adjusting chamber 85 and formed along the Y direction.

The first portion 811 is formed such that the end of the first portion 811 on the opposite side from the supply port O1 is located between the pressure adjusting chamber 85 and the second channel 82 in plan view from the Z direction. The second portion 812 is a portion of the first channel 81 formed from the end of the first portion 811 on the positive side in the Y direction toward the negative side in the Z direction. The second portion 812 is formed such that the end of the second portion 812 on the opposite side from the first portion 811 overlaps the pressure adjusting chamber 85 as viewed from the Y direction. The third portion 813 is a portion formed from the end of the second portion 812 on the opposite side from the first portion 811 to the pressure adjusting chamber 85. A filter chamber 87 is formed at an intermediate portion of the second portion 812 and overlaps a liquid storing chamber 80 in plan view. In the third embodiment, the filter chamber 87 is located between the pressure adjusting unit 253 and the second channel 82 in the Y direction in plan view from the Z direction. The first channel 81 communicates with the pressure adjusting chamber 85 from the second channel 82 side as viewed from the pressure adjusting chamber 85. Note that the filter chamber 87 may be formed at the first portion 811 or the third portion 813.

In the third embodiment too, as in the first embodiment, the supply port O1 is formed in a surface of the base body 251 other than a first surface S1, in which the liquid storing chamber 80 is formed. Accordingly, the size of the channel structure 25 can be reduced. In the third embodiment, the supply port O1 is formed in one of the side surfaces S3 of the base body 251. The size of the channel structure 25 in the Z direction can be smaller than that in the configuration in the first embodiment, in which the supply port O1 is formed in the second surface S2 of the base body 251 on the opposite side from the first surface S1. Also, the configuration of the first channel 81 is simpler than that in the configuration in the first embodiment, in which the supply port O1 is formed in the second surface S2.

Fourth Embodiment

Figure 6:
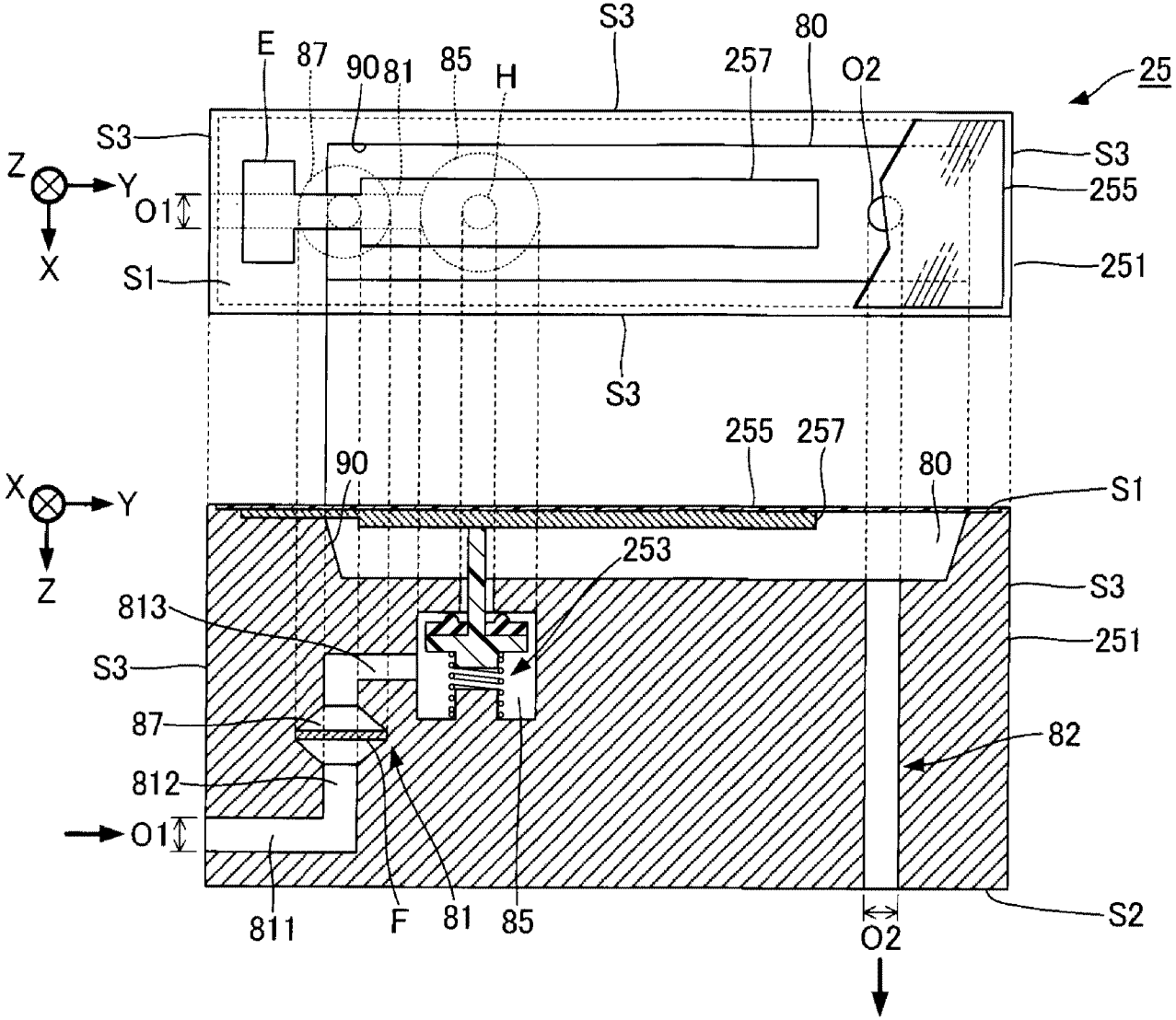
FIG. 6 is a plan view and a cross-sectional view of a channel structure according to a fourth embodiment.

FIG. 6 is a plan view and a cross-sectional view of a channel structure 25 according to a fourth embodiment. In the fourth embodiment, as in the third embodiment, a supply port O1 is formed in one of side surfaces S3 of a base body 251. However, a filter chamber 87 in the fourth embodiment is formed on the opposite side of a pressure adjusting unit 253 from a second channel 82 in the Y direction in plan view from the Z direction. As exemplarily illustrated in FIG. 6, the first channel 81 in the fourth embodiment includes a first portion 811, a second portion 812, and a third portion 813. The first portion 811 is a portion of the first channel 81 formed along the Y direction from the supply port O1. The second portion 812 is a portion of the first channel 81 communicating with the first portion 811 and formed along the Z direction. The third portion 813 is a portion of the first channel 81 communicating with the second portion 812 and a pressure adjusting chamber 85 and formed along the Y direction.

The first portion 811 is formed such that the end of the first portion 811 on the opposite side from the supply port O1 is located between the pressure adjusting chamber 85 and the side surface S3 of the base body 251 in a plan view. The second portion 812 is a portion of the first channel 81 formed from the end of the first portion 811 on the positive side in the Y direction toward the negative side in the Z direction. The second portion 812 is formed such that the end of the second portion 812 on the opposite side from the first portion 811 overlaps the pressure adjusting chamber 85 as viewed from the Y direction. The third portion 813 is a portion formed from the end of the second portion 812 on the opposite side from the first portion 811 to the pressure adjusting chamber 85. The filter chamber 87 is formed at an intermediate portion of the second portion 812. The first channel 81 communicates with the pressure adjusting chamber 85 from the opposite side of the pressure adjusting chamber 85 from the second channel 82. Note that the filter chamber 87 may be formed at the first portion 811 or the third portion 813.

The fourth embodiment also achieves an advantageous effect similar to that in the third embodiment. However, the size of the channel structure 25 in the Y direction, which is parallel to a first surface S1, can be smaller with the configurations in the first and third embodiments, in which the filter chamber 87 is located between the pressure adjusting unit 253 and the second channel 82 in the Y direction in plan view from the Z direction, than with the configurations in the second and fourth embodiments, in which the filter chamber 87 is formed on the opposite side of the pressure adjusting unit 253 from the second channel 82 in the Y direction in plan view.

Note that although the first channel 81 includes the first portion 811 and the second portion 812 in the third and fourth embodiments, the configuration of the first channel 81 is not limited to the above example. For example, a configuration in which the first channel 81 includes portions different from the first portion 811, the second portion 812, and the third portion 813 or a configuration in which the first channel 81 is in a straight shape may be employed. Also, although the second channel 82 is exemplarily described as being formed along the Z direction in the third and fourth embodiments, the configuration of the second channel 82 is not limited to the above example. For example, the second channel 82 may be formed of a plurality of different portions.

Modifications

The embodiments exemplarily described above may be modified in various ways. Specific modifications applicable to the foregoing embodiments will be exemplarily described below. Note that any two or more modifications selected from the following exemplary modifications can be combined as long as a contradiction does not occur.

(1) In the first embodiment, a configuration in which the entirety of the supply port O1 overlaps the liquid storing chamber 80 in plan view from the Z direction has been exemplarily described. However, a configuration in which part of the supply port O1 overlaps the liquid storing chamber 80 or a configuration in which the supply port O1 does not overlap the liquid storing chamber 80 may be employed. Nonetheless, the configuration in which the entirety of the supply port O1 overlaps the liquid storing chamber 80 in plan view from the Z direction is preferable in view of reducing the size of the channel structure 25.

(2) In each of the foregoing embodiments, the discharge port O2 is formed in the second surface S2. However, the discharge port O2 may be formed in the side surface S3 or the first surface S1 of the base body 251.

(3) In each of the foregoing embodiments, a configuration in which entirety of the pressure adjusting chamber 85 overlaps the liquid storing chamber 80 in plan view from the Z direction has been exemplarily described. However, a configuration in which part of the pressure adjusting chamber 85 overlaps the liquid storing chamber 80 or a configuration in which the pressure adjusting chamber 85 does not overlap the liquid storing chamber 80 may be employed. Nonetheless, the configuration in which the entirety of the pressure adjusting chamber 85 overlaps the liquid storing chamber 80 is preferable in view of reducing the size of the channel structure 25.

(4) In some of the foregoing embodiments, a configuration in which the entirety or part of the filter chamber 87 overlaps the liquid storing chamber 80 in plan view from the Z direction has been exemplarily described. However, a configuration in which the filter chamber 87 does not overlap the liquid storing chamber 80 may be employed. Nonetheless, the configuration in which the entirety of the filter chamber 87 overlaps the liquid storing chamber 80 is preferable in view of reducing the size of the channel structure 25.

(5) In each of the foregoing embodiments, the first channel 81 communicates with the side surface of the pressure adjusting chamber 85. However, the first channel 81 may communicate with the bottom surface of the pressure adjusting chamber 85, for example.

Figure 7:
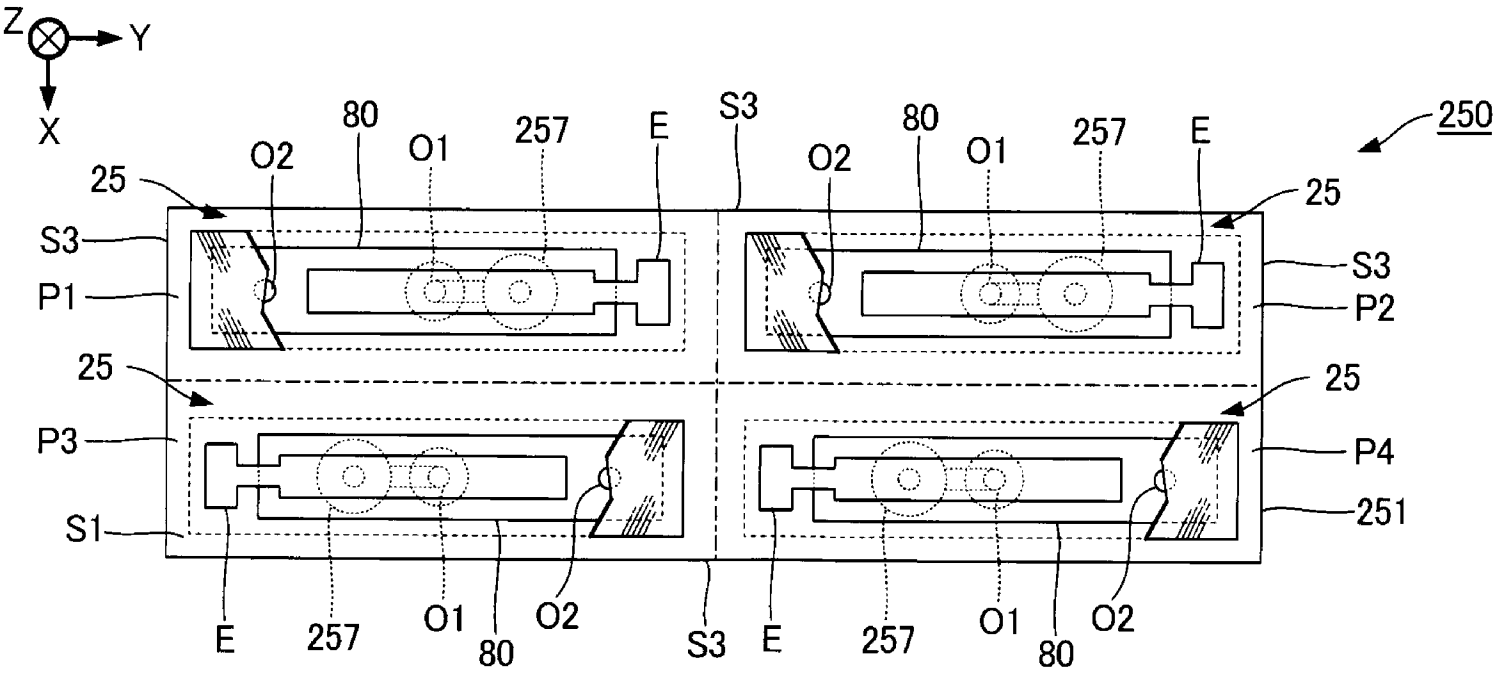
FIG. 7 is a plan view and a cross-sectional view of a channel structure according to a modification.

(6) A plurality of the channel structures 25 exemplarily described in any of the foregoing embodiments may be combined to form a single channel structure 250. For example, the channel structure 250 in FIG. 7 represents a configuration in which a first portion P1, a second portion P2, a third portion P3, and a fourth portion P4 are arranged in a 2×2 matrix. The liquid ejecting head 26 is disposed in each of the first portion P1 to the fourth portion P4.

Each of the first portion P1 to the fourth portion P4 has a similar configuration to the channel structure 25 exemplarily described in any of the foregoing embodiments. However, the base bodies 251 in the first portion P1 to the fourth portion P4 are formed as a single substrate. In plan view, in each of the first portion P1 and the second portion P2, which are arrayed in the Y direction, the fixed end E of the pressure receiving plate 257 is located on the positive side in the Y direction as viewed from the liquid storing chamber 80. On the other hand, in plan view, in each of the third portion P3 and the fourth portion P4, which are arranged in the Y direction, the fixed end E of the pressure receiving plate 257 is located on the negative side in the Y direction as viewed from the liquid storing chamber 80.

(7) In each of the foregoing embodiments, a valve device is used as the pressure adjusting unit 253. However, the pressure adjusting unit 253 is not limited to a valve device as long as it is a component that supplies the liquid to the liquid storing chamber 80.

(8) In each of the foregoing embodiments, the serial-type liquid ejecting apparatus 100 has been exemplarily described, which reciprocates the transporter 242 with the liquid ejecting head 26 mounted thereon. However, the present disclosure is also applicable to line-type liquid ejecting apparatuses having a plurality of nozzles N distributed over the entire width of the medium 12.

(9) The liquid ejecting apparatus 100 exemplarily described in each of the foregoing embodiments can be employed in various types of apparatuses such as fax machines and copy machines as well as apparatuses solely used for printing. Meanwhile, the application of the liquid ejecting apparatus of the present disclosure is not limited to printing. For example, a liquid ejecting apparatus that ejects a solution of a color material may be used as a manufacturing apparatus that forms a color filter for liquid crystal display apparatuses. Moreover, a liquid ejecting apparatus that ejects a solution of an electrically conductive material may be used as a manufacturing apparatus that forms wirings and electrodes of wiring boards.

What is claimed is:

1. A channel structure comprising a base body having a first surface, a second surface that is opposite from the first surface, and a side surface that extends in a direction intersecting the first surface, the base body comprising:

a first channel having a supply port into which a liquid is supplied;

a liquid storing chamber formed in the first surface and storing the liquid;

a second channel having a discharge port through which the liquid in the liquid storing chamber is discharged; and a pressure adjusting unit that supplies the liquid from the first channel to the liquid storing chamber according to pressure in the liquid storing chamber, and that located between the first surface and the second surface, wherein the supply port is formed in the second surface of the base body or formed in the side surface of the base body, and at least a part of the first channel is located between the pressure adjusting unit and the second channel when viewed from a direction perpendicular to the first surface.

2. The channel structure according to claim 1, wherein the supply port is formed in the second surface of the base body.

3. The channel structure according to claim 2, wherein the supply port overlaps the liquid storing chamber when viewed from a direction perpendicular to the first surface.

4. The channel structure according to claim 1, wherein the supply port is formed in the side surface of the base body.

5. The channel structure according to claim 1, wherein the first channel is located between the pressure adjusting unit and the second channel when viewed from a direction perpendicular to the first surface.

6. The channel structure according to claim 1, wherein the pressure adjusting unit is disposed in a pressure adjusting chamber, and the first channel communicates with the second channel side of the pressure adjusting chamber when viewed from the pressure adjusting chamber.

7. A liquid ejecting apparatus comprising:

the channel structure according to claim 1;

a liquid ejecting head that ejects the liquid supplied from the channel structure; and a controller that controls the liquid ejecting head.

8. The channel structure according to claim 1, wherein both the supply port and the discharge port are formed in a same surface that is the side surface of the base body.

9. The channel structure according to claim 1, wherein the first channel and the second channel are on a same side of the pressure adjusting unit when viewed from a direction that is perpendicular to the first surface.

10. The channel structure according to claim 1, further comprising a filter located at an intermediate portion of the first channel, wherein the filter overlaps the liquid storing chamber when viewed from a direction perpendicular to the first surface.

11. A channel structure comprising, in a base body having a first surface:

a first channel having a supply port into which a liquid is supplied;

a liquid storing chamber formed in the first surface and storing the liquid;

a second channel having a discharge port through which the liquid in the liquid storing chamber is discharged; and a pressure adjusting unit that supplies the liquid from the first channel to the liquid storing chamber according to pressure in the liquid storing chamber, wherein the first channel includes one end and another end that is opposite from the one end, the supply port is located at the one end of the first channel, the first channel is connected to the pressure adjusting unit at the other end of the first channel, the supply port overlaps the liquid storing chamber when viewed from a direction perpendicular to the first surface, the base body having a second surface that is opposite from the first surface, the supply port is formed in the second surface of the base body, and the second surface is a part of an outer wall of the base body.

12. A liquid ejecting unit comprising:

the channel structure according to claim 1; and a liquid ejecting head that ejects the liquid supplied from the channel structure.

13. A liquid ejecting unit comprising:

the channel structure according to claim 11; and a liquid ejecting head that ejects the liquid supplied from the channel structure.

14. A liquid ejecting apparatus comprising:

the channel structure according to claim 11;

a liquid ejecting head that ejects the liquid supplied from the channel structure; and a controller that controls the liquid ejecting head.

15. The channel structure according to claim 11, wherein both the supply port and the discharge port are formed in a same surface that is the second surface of the base body or the side surface of the base body.

16. The channel structure according to claim 11, wherein the first channel and the second channel are on a same side of the pressure adjusting unit when viewed from a direction that is perpendicular to the first surface.

17. The channel structure according to claim 11, further comprising a filter located at an intermediate portion of the first channel, wherein the filter overlaps the liquid storing chamber when viewed from a direction perpendicular to the first surface.

18. The channel structure according to claim 11, wherein an entirety of the first channel overlaps the liquid storage chamber when viewed from a direction perpendicular to the first surface.

19. A channel structure comprising a base body having a first surface, a second surface that is opposite from the first surface, and a side surface that extends in a direction intersecting the first surface, the base body comprising:

a first channel having a supply port into which a liquid is supplied;

a liquid storing chamber formed in the first surface and storing the liquid;

a second channel having a discharge port through which the liquid in the liquid storing chamber is discharged; and a pressure adjusting unit that supplies the liquid from the first channel to the liquid storing chamber according to pressure in the liquid storing chamber, and that located between the first surface and the second surface, wherein the supply port is formed in the second surface of the base body or formed in the side surface of the base body, and the first channel and the second channel are on a same side of the pressure adjusting unit when viewed from a direction that is perpendicular to the first surface.

* * * * *